United States Patent [19]

Arjmand

[11] Patent Number: 5,067,158

[45] Date of Patent: Nov. 19, 1991

[54] LINEAR PREDICTIVE RESIDUAL REPRESENTATION VIA NON-ITERATIVE SPECTRAL RECONSTRUCTION

[75] Inventor: Masud M. Arjmand, Richardson, Tex.

[73] Assignee: Texas Instruments Incorporated, Dallas, Tex.

[21] Appl. No.: 744,171

[22] Filed: Jun. 11, 1985

[51] Int. Cl.[5] ..... G10L 7/06

[52] U.S. Cl. ..... 381/51

[58] Field of Search ..... 381/29-50; 364/513.5

[56] References Cited

U.S. PATENT DOCUMENTS

| | | | |
|---|---|---|---|
| 4,058,676 | 11/1977 | Wilkes et al. | 381/49 |
| 4,209,836 | 6/1980 | Wiggins, Jr. et al. | 364/718 |
| 4,216,354 | 8/1980 | Esteban et al. | 381/31 |
| 4,220,819 | 9/1980 | Atal | 381/38 |
| 4,343,969 | 8/1982 | Kellett | 381/45 |
| 4,516,259 | 5/1985 | Yato et al. | 381/36 |
| 4,569,075 | 2/1986 | Nussbaumer | 381/34 |

OTHER PUBLICATIONS

Yegnanarayana et al., "Significance of Group Delay Functions in Signal Reconstruction from Spectral Magnitude of Phase", IEEE Trans. on ASSP, vol. ASSP-32, No. 3, Jun. 1984.

Hayes et al., "Signal Reconstruction from Phase or Magnitude", IEEE Trans. on ASSP, vol. ASSP-28, No. 6, Dec. 1980, pp. 672-680.

"Linear Prediction: A Tutorial Review"-John Makhoul, Proceedings of the IEEE, vol. 63, No. 4, pp. 561-580 (Apr. 1975).

"Signal Reconstruction from Phase or Magnitude"-M. H. Hayes, J. S. Lim, and A. V. Oppenheim, *IEEE Transactions-Acoustics, Speech and Signal Processing,* vol. ASSP-28, pp. 672-680 (Dec. 1980).

"Iterative Techniques for Minimum Phase Signal Reconstruction from Phase or Magnitude"-T. F. Quatieri, Jr. and A. V. Oppenheim, *IEEE Transactions-Acoustics, Speech and Signal Processing,* vol. ASSP-29, pp. 1187-1193 (Dec. 1981).

"Non-Iterative Techniques for Minimum Phase Signal Reconstruction from Phase or Magnitude"-B. Yegnanarayana and A. Dhayalan, Proceedings of ICASSP-83, Boston, pp. 639-642 (Apr. 1983).

"Significance of Group Delay Functions in Signal Reconstruction from Spectral Magnitude or Phase"-B. Yegnanarayana, D. K. Saikia, and T. R. Krishnan, IEEE Transactions-Acoustics, Speech and Signal Processing, vol. ASSP-32, pp. 610-623 (Jun. 1984.

"The Cepstrum: A Guide to Processing"-D. G. Childers, D. P. Skinner, and R. C. Kemerait, Proceedings of the IEEE, vol. 65, pp. 1428-1443 (Oct. 1977).

*Primary Examiner*—Dale M. Shaw
*Assistant Examiner*—David D. Knepper
*Attorney, Agent, or Firm*—William E. Hiller; N. Rhys Merrett; Melvin Sharp

[57] ABSTRACT

Method of encoding speech at medium to high bit rates while maintaining very high speech quality, as specifically directed to the coding of the linear predictive (LPC) residual signal using either its Fourier Transform magnitude or phase. In particular, the LPC residual of the speech signal is coded using minimum phase spectral reconstruction techniques by transforming the LPC residual signal in a manner approximately a minimum phase signal, and then applying spectral reconstruction techniques for representing the LPC residual signal by either its Fourier Transform magnitude or phase. The non-iterative spectral reconstruction technique is based upon cepstral coefficients through which the magnitude and phase of a minimum phase signal are related. The LPC residual as reconstructed and regenerated is used as an excitation signal to a LPC synthesis filter in the generation of analog speech signals via speech synthesis from which audible speech may be produced.

11 Claims, 2 Drawing Sheets

LINEAR PREDICTIVE RESIDUAL REPRESENTATION VIA NON-ITERATIVE SPECTRAL RECONSTRUCTION

BACKGROUND OF THE INVENTION

The present invention generally relates to a method for encoding speech, and more particularly to the coding of the linear predictive (LPC) residual signal by using either its Fourier Transform magnitude or phase.

The encoding of digital speech data as derived from analog speech signals to enable the speech information to be placed in a compressed form for storage and transmission as speech signals using a reduced bandwidth has long been recognized as a desirable goal. Speech encoding produces a significant compression in the speech signal as derived from the original analog speech signal which can be utilized to advantage in the general synthesis of speech, in speech recognition and in the transmission of spoken speech.

A technique known as linear predictive coding is commonly employed in the analysis of speech as a means of compressing the speech signal without sacrificing much of the actual information content thereof in its audible form. This technique is based upon the following relation:

$$s_n = -\sum_{k=1}^{P} a_k s_{n-k} + G\sum_{l=0}^{q} b_l u_{n-l},\ b_o = 1 \tag{1}$$

where $s_n$ is a signal considered to be the output of some system with some unknown input $u_n$, with $a_k$, $1 \leqq k \leqq p$, $b_l$, $1 \leqq l \leqq q$, and the gain G being the parameters of the hypothesized system. In equation (1), the "output" $s_n$ is a linear function of past outputs and present and past inputs. Thus, the signal $s_n$ is predictable from linear combinations of past outputs and inputs, whereby the technique is referred to as linear prediction. A typical implementation of linear predictive coding (LPC) of digital speech data as derived from human speech is disclosed in U.S. Pat. No. 4,209,836 Wiggins, Jr. et al issued June 24, 1980 which is hereby incorporated by reference. As noted therein, linear predictive coding systems generally employ a multi-stage digital filter in processing the encoded digital speech data for generating an analog speech signal in a speech synthesis system from which audible speech is produced.

By taking the z transform on both sides of equation (1), where H(z) is the transfer function of the system, the following relationship is obtained:

$$H(z) = \frac{S(z)}{U(z)} = G\frac{1 + \sum_{l=1}^{q} b_l z^{-l}}{1 + \sum_{k=1}^{P} a_k z^{-k}} \tag{2}$$

where $$S(z) = \sum_{n=-\infty}^{\infty} s_n z^{-n} \tag{3}$$

is the z transform of $s_n$, and U(z) is the z transform of $u_n$. In equation (2), H(z) is the general pole-zero model, with the roots of the numerator and denominator polynomials being the zeros and poles of the model, respectively. Linear predictive modeling generally has been accomplished by using a special form of the general pole-zero model of equation (2), namely—the autoregressive or all-pole model, where it is assumed that the signal $s_n$ is a linear combination of past values and some input $u_n$, as in the following relationship:

$$S_n = -\sum_{k=1}^{P} a_k s_{n-k} + Gu_n \tag{4}$$

where G is a gain factor. The transfer function H(z) in equation (2) now reduces to an all-pole transfer function $$H(z) = \frac{G}{1 + \sum_{k=1}^{P} a_k z^{-k}} \tag{5}$$

Given a particular signal sequence $s_n$, speech analysis according to the all-pole transfer function of equation (5) produces the predictor coefficients $a_k$ and the gain G as speech parameters. To represent speech in accordance with the LPC model, the predictor coefficients $a_k$, or some equivalent set of parameters, such as the reflection coefficients $k_k$, must be transmitted so that the linear predictive model can be used to re-synthesize the speech signal for producing audible speech at the output of the system. A detailed discussion of linear prediction as it pertains to the analysis of discrete signals is given in the article "Linear Prediction: A Tutorial Review"—John Makhoul, *Proceedings of the IEEE*, Vol. 63, No. 4, pp. 561–580 (April 1975) which is hereby incorporated by reference.

In linear predictive coding, a residual error signal (i.e., the LPC residual signal) is created. In order to encode speech using the linear predictive coding technique at medium to high bit rates (e.g. a medium rate of 8000–16,000 bits per second, and a high bit rate in excess of 16,000 bits per second) while maintaining very high speech quality, an encoding technique including the coding of the LPC residual signal would be desirable. In general, the LPC residual signal may be considered a non-minimum phase signal ordinarily requiring knowledge of both the Fourier Transform magnitude and phase in order to fully correspond to the time domain waveform. In the time domain, the energy density of a minimum phase signal is higher around the origin and tends to decrease as it moves away from the origin. During periods of voiced speech, the energy in the LPC residual is relatively low except in the vicinity of a pitch pulse where it is generally significantly higher. Based upon these observations, it has been determined in accordance with the present invention that the LPC residual of a speech signal may be transformed in a manner permitting its encoding at medium to high bit rates while maintaining very high quality speech.

SUMMARY OF THE INVENTION

The present invention is directed to a method of encoding speech at medium to high bit rates while maintaining very high speech quality using the linear predictive coding technique and being directed specifically to the coding of the LPC residual signal, wherein minimum phase spectral reconstruction is employed. In its broadest aspect, the method takes advantage of the fact that a minimum phase signal can be substantially completely specified in the time domain by either its Fourier Transform magnitude or phase. Thus, the method transforms the LPC residual of a speech signal to a minimum phase signal and then applies spectral reconstruction to represent the LPC residual by either its Fourier Transform magnitude or phase.

More specifically, the method according to the present invention is effective to transform the LPC residual signal to a signal that is as close to being minimum phase as possible. To this end, each frame of digital speech data defining the LPC residual signal is circularly shifted to align the peak residual value in the frame with the origin of the signal. This has the effect of approximately removing the linear phase component. Thereafter, an energy-based dispersion measure is determined for the time-shifted frame of digital speech data, and a weighting factor is applied to the time-shifted frame. The energy-based dispersion measure is smaller if most of the signal energy is concentrated at the beginning of the frame of digital speech data and is larger for relatively broader signals. The weighting factor is inversely proportional to the speech frame dispersion such that a relatively large dispersion common to frames of digital speech data representative of unvoiced speech is compensated by a proportionally small weighting factor. Following exponential weighting of the speech frame by the weighting factor, the now-transformed LPC residual signal as represented by the frame of digital speech data will approximate, if not equal, a minimum phase signal. For practical purposes, the transformed frame of speech data representative of the LPC residual can be assumed to be minimum phase and may be represented by either its Fourier Transform magnitude or phase. A non-iterative cepstrum-based minimum phase reconstruction technique may be employed with respect to either the Fourier Transform magnitude or the phase for obtaining the equivalent minimum phase signal, the latter technique being based upon the recognition that the magnitude and phase of a minimum phase signal are related through cepstral coefficients. The circular shift and the exponential weighting are restored to the signal as obtained from the non-iterative spectral reconstruction so as to regenerate the LPC residual signal for use as an excitation signal with the LPC synthesis filter in the generation of audible speech.

The novel features believed characteristic of the invention are set forth in the appended claims. The invention itself, however, as well as other features and advantages thereof, will be best understood by reference to the drawings and the detailed description which follows.

DETAILED DESCRIPTION OF THE INVENTION

Figure 1:
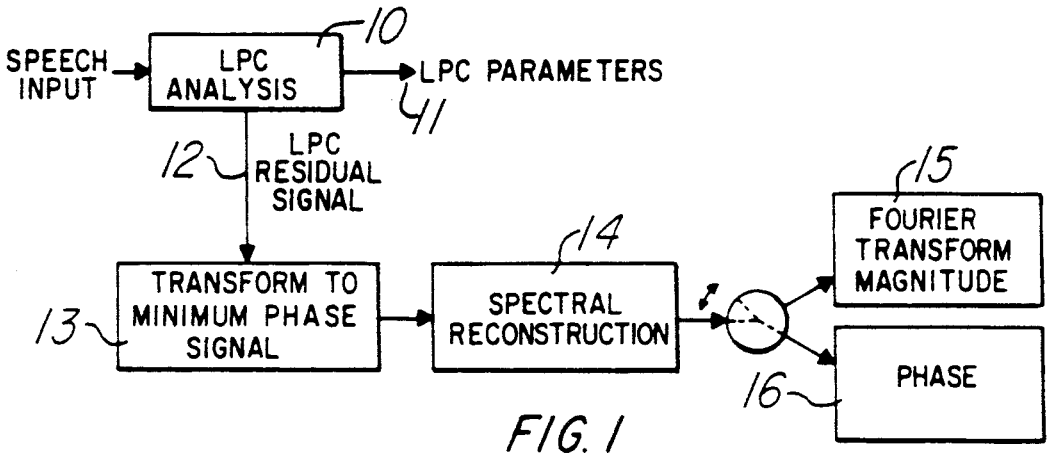
FIG. 1 is a block diagram of the method of encoding a linear predictive residual signal in accordance with the present invention.
Figure 2:
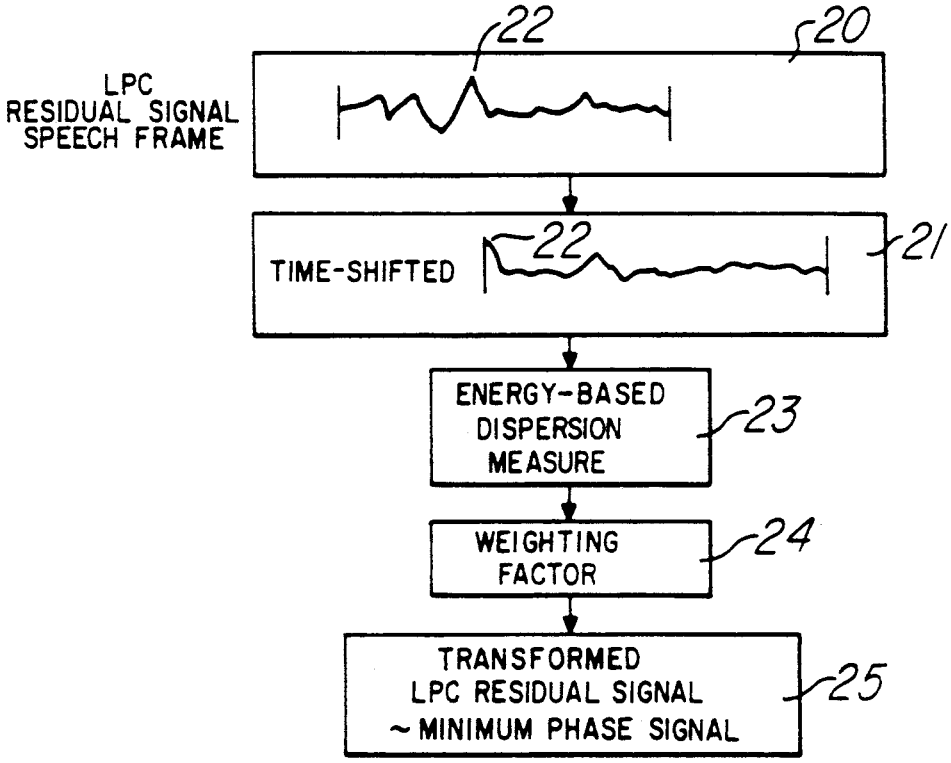
FIG. 2 is a block diagram illustrating the transformation of a linear predictive residual signal to a signal approximating minimum phase in practicing the method shown in FIG. 1.

Referring to FIGS. 1 and 2 of the drawings, present invention is directed to a method for encoding the LPC residual signal of a speech signal using minimum phase spectral reconstruction such that either the Fourier Transform magnitude or phase may be employed to represent the encoded form of the LPC residual signal. Initially, a speech signal is provided as an input to an LPC analysis block 10. The LPC analysis can be accomplished by a wide variety of conventional techniques to produce as an end product, a set of LPC parameters 11 and an LPC residual signal 12. In this respect, the typical analysis of a sampled analog speech waveform by the linear predictive coding technique produces an LPC residual signal 12 as a by-product of the computation of the LPC parameters 11. Generally, the LPC residual signal may be regarded as a non-minimum phase signal which would require both the Fourier Transform magnitude and phase to be known in order to completely specify the time domain waveform thereof. The method in accordance with the present invention involves the transformation of the LPC residual signal to a minimum phase signal as at 13 by performing relatively uncomplicated operations on respective frames of digital speech data representative of the LPC residual signal so as to provide a transformed speech frame approximating, if not equal to, a minimum phase signal. In this respect, the LPC residual signal is subjected to preliminary processing in the time domain so as to be transformed to a signal that is as close to being of minimum phase as possible. Thereafter, the LPC residual signal is subjected to spectral reconstruction as at 14, being transformed to the frequency domain by Fourier Transform and is treated as a minimum phase signal for all practical purposes. At this stage, the transformed LPC residual signal can be represented either by its Fourier Transform magnitude 15 or phase 16.

A speech signal as presented in digital form may be generally represented in the Fourier Transform domain by specifying both its spectral magnitude and phase. So-called minimum phase signals can be completely identified or specified within certain conditions by either the spectral magnitude or phase thereof. In the latter connection, the phase of a minimum phase signal is capable of specifying the signal to within a scale factor, whereas the magnitude of a minimum phase signal can completely specify the signal within a time shift. In many practical situations, e.g. in image reconstruction, signal information may be available only with respect to either the magnitude or the phase of the signal. Several iterative techniques have been developed to recover the unknown magnitude (or phase) from the known phase (or magnitude) of a signal. To this end, attention is directed to the techniques described in "Signal Reconstruction from Phase or Magnitude"—M. H. Hayes, J. S. Lim, and A. V. Oppenheim, *IEEE Transactions—Acoustics, Speech and Signal Processing*, Vol. ASSP-28, pp. 672–680 (December 1980), and "Iterative Techniques for Minimum Phase Signal Reconstruction from Phase or Magnitude"—J. E. Quatieri and A. V. Oppenheim, *IEEE Transactions—Acoustics, Speech and Signal Processing*, Vol. ASSP-29, pp. 1187–1193 (December 1981). Techniques such as those described in these publications iteratively switch back and forth between time and frequency domains, each time imposing certain conditions (e.g., causality, known phase or magnitude) on the signal being reconstructed.

More recently, techniques have been suggested for non-iterative reconstruction of minimum phase signals from either the spectral phase or magnitude, as for example in "Non-iterative Techniques for Minimum Phase Signal Reconstruction from Phase or Magnitude"—B. Yegnanarayana, *Proceedings of ICASSP—83, Boston*, pp. 639–642 (April 1983) and "Significance of Group Delay Functions in Signal Reconstruction from Spectral Magnitude or Phase"—B. Yegnanarayana, D. K. Saikia and T. R. Krishnan, *IEEE Transactions—Acoustics, Speech and Signal Processing*, Vol. ASSP-32, pp. 610–623 (June 1984). The latter techniques exploit the relationship between the magnitude and phase of a minimum phase signal through the cepstral coefficients.

Considering non-iterative spectral reconstruction of a signal, for a minimum phase signal v(n), the Fourier Transform thereof may be expressed as:

$$V(w) = |V(w)| * \text{Exp}\ (j\theta(w) \tag{6}$$

It can be shown from the above-referenced publication of Yegnanarayana et al, "Significance of Group Delay Functions in Signal Reconstruction from Spectral Magnitude or Phase" that $$Ln|V(w)| = c(0)/2 + c(n) * \text{Cos}\ (nw) \tag{7}$$

$$\theta(w) = -c(n) * \text{Sin}\ (nw) \tag{8}$$

where c(n) are the cepstral coefficients.

A detailed treatment of the cepstrum occurs in the publication, "The Cepstrum: A Guide to Processing'-'—D. G. Childers, D. P. Skinner, and R. C. Kemarait, *Proceedings of the IEEE*, Vol. 65, pp. 1428–1443 (October 1977). Each of the five published articles as referred to herein is hereby incorporated by reference.

From equations (7) and (8), a minimum phase equivalent sequence for a given Fourier transform magnitude function may be generated, as for example in accordance with the description in the publication "Significance of Group Delay Functions in Signal Reconstruction from Spectral Magnitude or Phase" by Yegnanarayana et al as previously referred to, in the following manner.

1. Given an N-length sequence V(k) representing the spectral magnitude, Ln|V(k)| is determined.

2. The cepstral coefficient sequence is then computed by transforming the sequence previously provided by inverse Fourier Transform:

$$c(k) = IFFT\ [Ln|V(k)|]$$

3. Another sequence g(k) is now obtained subject to the conditions that:

$$g(k) = 0 \text{ for } k = 0$$
$$g(k) = c(k) \text{ for } 1 < k < = N/2$$
$$g(k) = -c(k) \text{ for } N/2 < k < = N - 1$$

4. $j\theta$ (k)=FFT [g(k)]

5. V(k)=|V(k)| *Exp [$j\theta$ (k)]

6. The minimum phase equivalent sequence x(k) can now be generated in accordance with the relationship:

$$x(k) = IFFT\ [V(k)]$$

In accordance with the present invention, the linear prediction residual signal for speech signals has been represented by its spectral magnitude by adapting the minimum phase equivalent sequence for use with the linear prediction residual signal. Since the linear prediction residual signal generally is not regarded as a minimum phase signal, the method in accordance with the present invention contemplates the transformation of the LPC residual signal to a form which is as close as possible to a minimum phase signal. In this respect, a minimum phase sequence has all of its poles and zeros within the unit circle. Theoretically, any finite length mixed phase signal can be transformed to a minimum phase signal by applying an exponential weighting to its time domain waveform:

$$y(n) = x(n)*(a**n)$$

$$Y(z) = X(z/a) \tag{9}$$

If a is less than unity, the zeros of x(n) are radially compressed, and if a is appropriately chosen to be less than the reciprocal of magnitude of the largest zero of the sequence x(n), all zeros of y(n) will be located within the unit circle and y(n) will be a minimum phase sequence. An effort to provide an exact computation of this weighting factor may be prohibitive, since this would require solving for the roots of the residual polynomial. However, an approximate method for determining the value a based upon the energy characteristics of minimum phase signals and the LPC residual in accordance with the present invention has been developed.

To the latter end, it has been observed that in the time domain, the energy density of a minimum phase signal will be higher around the origin than farther away from the origin. During voiced regions of speech, energy in the LPC residual is relatively low, except in the vicinity of a pitch pulse where it is generally significantly higher. Based upon these observations, the weighting factor a may be determined by computing an energy-based measure of dispersion for each speech data frame of the LPC residual, as follows:

$$D = \sum_n n*x(n)2 / \sum_n x(n)2 \tag{10}$$

This dispersion measure D is smaller if most of the signal energy is concentrated around the beginning of the speech frame and is larger for relatively broader signals. The weighting factor is determined to be inversely proportional to frame dispersion (i.e. a=I/D). Therefore, the large dispersion of unvoiced speech frames is compensated by a proportionally small weighting factor. Exponentially weighting each frame of digital speech data representative of the LPC residual by such a weighting factor compresses most of the energy of the speech frame toward the origin.

However, initially the linear phase component in the speech frame representative of the LPC residual must be completely or substantially removed prior to the application of the weighting factor thereto. This is accomplished by circularly rotating the speech frame to align the peak residual value in the frame at the origin thereof. The speech frame as so transformed will now approximate, if not exactly equal, minimum phase and may be assumed to be minimum phase for all practical purposes so as to be represented by its Fourier Transform magnitude. The equivalent minimum phase signal is obtained from the magnitudes through the non-iterative cepstrum-based minimum phase reconstruction technique described earlier, with the circular shift and the exponential weighting being restored to this signal for regenerating the LPC residual signal which can then be used as an excitation signal to the LPC synthesis filter in the generation of audible speech via speech synthesis.

FIG. 2 illustrates the transformation of the LPC residual signal to a minimum phase signal as generally symbolized by the block 13 in FIG. 1. To this end, the linear phase component in the speech frame 20 representative of the LPC residual signal is time-shifted by circularly rotating the speech frame as at 21 to align the peak residual value 22 in the frame at the origin thereof. Next, an energy-based measure of dispersion for each time-shifted speech data frame of the LPC residual signal is computed as at 23 in accordance with the relationship provided by equation (10) from which the weighting factor a is determined as being inversely proportional to frame dispersion D. Each frame of digital speech data representative of the time-shifted LPC residual signal is then exponentially weighted by such a weighting factor as at 24 which compresses the energy of the speech frame toward the origin thereof. This causes the transformed speech frame to approximate a minimum phase signal as at 25.

Figure 3:
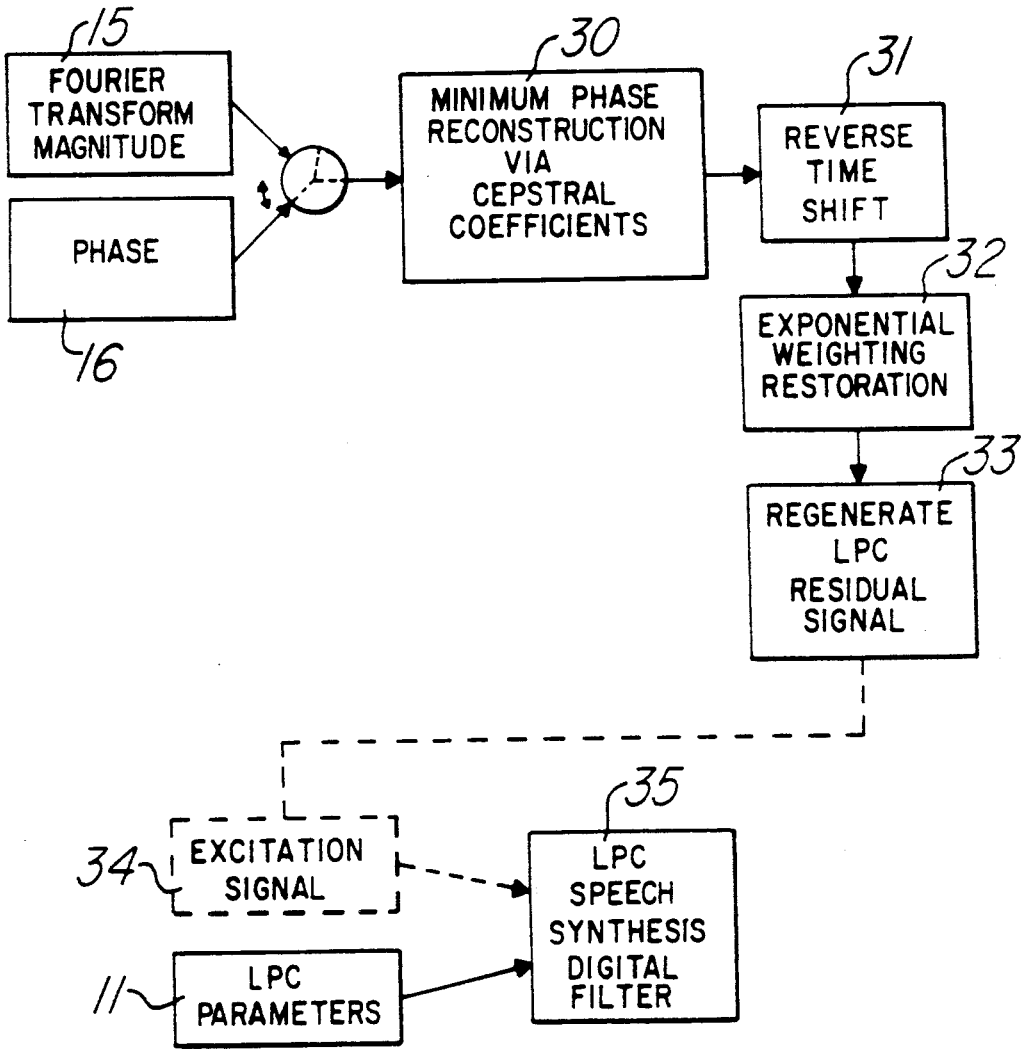
FIG. 3 is a block diagram illustrating the regeneration of the linear predictive residual signal for use as an excitation signal in the generation of audible synthesized speech.

In FIG. 3, the Fourier Transform magnitude 15 or the phase 16 as obtained via the encoding procedure illustrated in FIG. 1 may be used as a starting point from which the LPC residual signal 12 may be regenerated. In this respect, either the Fourier Transform magnitude 15 or phase 16 representing the encoded version of the LPC residual signal 12 is subjected to a non-iterative minimum phase reconstruction via cepstral coefficients as at 30 in the manner previously explained by employing the relationships provided by equations (7) and (8). Thereafter, the equivalent minimum phase signal is subjected to a reverse time shift as at 31 where the time-shifting by circular rotation of the speech frame illustrated in FIG. 2 at 20 and 21 is reversed, and the exponential weighting is then restored to the resulting signal as at 32 to regenerate the LPC residual signal as at 33. The regenerated LPC residual signal may be employed as the excitation signal 34 along with the LPC parameters 11 originally produced by the LPC analysis of the speech signal input, with the excitation signal 34 and the LPC parameters 11 serving as inputs to an LPC speech synthesis digital filter 35. The digital filter 35 produces a digital speech signal as an output which may be converted to an analog speech signal comparable to the original analog speech signal and from which audible synthesized speech may be produced.

In summary, the method for generating speech from a phase-only or magnitude-only LPC residual signal contemplates the following procedures for each frame of speech data:

1. LPC speech analysis techniques are applied to an analog speech signal input to determine an optimum prediction filter, and the input speech signal is then processed by the optimum prediction filter to generate an LPC residual error signal.

2. The LPC residual signal is segmented into individual speech frames containing N data samples (e.g. N is a power of 2, typically N=128). A certain amount of overlap, typically eight points, is provided with each of the two adjacent frames in the segmentation of the LPC residual signal.

3. Each speech frame is then searched for its peak value, and the speech data in the frame is circularly shifted such that the peak value will occur at the first point in the frame, thereby aligning the peak residual value with the origin of the frame. The number of samples shifted is retained for subsequent use.

4. An energy-based dispersion measure D is computed in accordance with equation (10) for the speech frame, this dispersion measure D being related to the spread of signal energy in the frame so as to be smaller if most of the signal energy is concentrated around the beginning of the frame and to be larger for relatively broader signals.

5. A weighting factor a=I/D, thereby being inversely proportional to the dispersion measure D, is applied to the frame of speech data, with each sample in the frame being exponentially weighted by multiplying it with the weighting factor raised to the position of this sample from the beginning of the frame (in number of samples). The weighting factor is retained for subsequent use.

6. The transformed frame of speech data representative of the LPC residual is now approximately, if not equal to, minimum phase and may be assumed to be minimum phase. Here, either the Fourier Transform magnitudes or the phase can be dropped, with the LPC residual signal being efficiently represented by the remainder of these two quantities as a coded signal. For example, the Fourier Transform magnitudes of the minimum phase speech data frame may be determined, with the phase information being dropped.

7. The LPC residual signal can be regenerated by deriving either the magnitude or the phase information (whichever is missing) from the phase or magnitude information (whichever is available) using non-iterative minimum phase reconstruction techniques as based upon the relationship of the magnitude and the phase of a minimum phase signal through the cepstral coefficients.

8. Once the minimum phase equivalent of the transformed LPC residual has been obtained, the speech frame is exponentially weighted by a factor that is the reciprocal of the original weighting factor so as to restore the amount by which the LPC residual was originally shifted.

9. The LPC synthesis filter as determined by the LPC filter coefficients previously established may now be excited by the restored residual in generating the reconstructed speech as audible speech via speech synthesis.

This technique is capable of reconstructing very high quality speech as encoded at medium to high bit rates and is of significance in providing high quality voice messaging and in telecommunication applications. The actual bit rate obtained will depend upon the type of quantization and the number of bits used to represent the phases or the magnitudes, the LPC parameters and the transformation parameters. In this respect, it will be understood that high quality speech can be generated by using an excitation signal derived only from the Fourier transform magnitude or phase of the original LPC residual signal in accordance with the present invention, thus ignoring either phase or magnitude information contained in the original LPC residual signal.

Although a preferred embodiment of the invention has been specifically described, it will be understood that the invention is to be limited only by the appended claims, since variations and modifications of the preferred embodiment will become apparent to persons skilled in the art upon reference to the description of the invention herein. Therefore, it is contemplated that the appended claims will cover any such modifications or embodiments that fall within the true scope of the invention.

What is claimed is:

1. A method of encoding a linear predictive residual signal as derived from an analog speech signal, wherein said linear predictive residual signal is in the form of a plurality of frames of digital speech data, said method comprising the steps of:

transforming each frame of digital speech data to a frame of digital speech data at least approximating minimum phase; and subjecting the transformed frame of digital speech data at least approximating minimum phase to a Fourier Transform procedure, thereby providing an encoded version of the frame in which one of the magnitude and the phase information is representative of the original frame of digital speech data which forms part of the original linear predictive residual signal, and the other of the magnitude and the phase information does not occur in the encoded version of the frame.

2. A method as set forth in claim 1, wherein the Fourier Transform magnitude is the encoded version of the original frame of digital speech data which forms part of the original linear predictive residual signal.

3. A method as set forth in claim 1, wherein the Fourier Transform phase is the encoded version of the original frame of digital speech data which forms part of the original linear predictive residual signal.

4. A method as set forth in claim 1, further including restoring said encoded version of the frame to the original frame of digital speech data; and regenerating the linear predictive residual signal.

5. A method as set forth in claim 4, further including employing the regenerated linear predictive residual signal as an excitation signal in conjunction with linear predictive speech parameters in a linear predictive speech synthesis filter from which audible speech may be derived.

6. A method of encoding a linear predictive residual signal as derived from an analog speech signal, wherein said linear predictive residual signal is in the form of a plurality of frames of digital speech data, said method comprising the steps of:

searching each frame of digital speech data to detect the peak residual value occurring therein;

time-shifting the digital speech data included in the frame to align the peak residual value with the origin of the frame;

determining a dispersion measure D for the frame in accordance with the relationship $$D = \sum_n n^*x(n)^{}2 / \sum_n x(n)^{}2$$

where n is the number of samples included in the frame of digital speech data, and x is the energy value of a respective sample of the frame;

weighting the frame of digital speech data in a manner inversely proportional to the dispersion measure D to provide a transformed frame of digital speech data at least approximating a minimum phase signal; and subjecting the weighted frame of digital speech data to a Fourier Transform procedure, thereby providing an encoded version of the frame in which one of the magnitude and the phase information is representative of the original frame of digital speech data which forms part of the original linear predictive residual signal.

7. A method as set forth in claim 6, wherein weighting the frame of digital speech data is accomplished by applying a weighting factor a in accordance with the relationship $$a = 1/D$$

where D is said dispersion measure, exponentially to each sample included in the frame.

8. A method as set forth in claim 7, wherein the magnitude information is the encoded version of the frame representative of the original frame of digital speech data.

9. A method as set forth in claim 7, wherein the phase information is the encoded version representative of the original frame of digital speech data.

10. A method as set forth in claim 7, further including restoring the encoded version of the frame to the transformed frame of digital speech data at least approximating minimum phase by employing a non-iterative spectral reconstruction, and removing the weighting of the frame of digital speech data and time-shifting the digital speech data included in the frame to return the peak residual value occurring therein to its original position, thereby regenerating the original frame of digital speech data which forms part of the original linear predictive residual signal.

11. A method as set forth in claim 10, further including employing the regenerated linear predictive residual signal as an excitation signal with linear predictive speech parameters in a linear predictive coding speech synthesis filter from which audible speech is to be derived.

* * * * *